United States Patent [19]

Dixon

[11] Patent Number: 4,949,845

[45] Date of Patent: Aug. 21, 1990

[54] FOLDING CARTON WITH RECLOSABLE TUCK AND DISPOSABLE HANG PANEL

[75] Inventor: Rodney D. Dixon, Burlington, N.C.

[73] Assignee: Mebane Packaging Corporation, Mebane, N.C.

[21] Appl. No.: 436,355

[22] Filed: Nov. 14, 1989

[51] Int. Cl.[5] ..... B65D 5/54

[52] U.S. Cl. ..... 206/626; 206/621; 206/628; 206/806

[58] Field of Search ..... 206/621, 626, 628, 629, 206/806, 807

[56] References Cited

U.S. PATENT DOCUMENTS

| | | | |
|---|---|---|---|
| 3,122,304 | 2/1964 | Kearney | 206/629 |
| 3,237,836 | 3/1966 | Nowak et al. | 229/16 |
| 3,563,451 | 2/1971 | Rosenburg, Jr. | 206/629 |
| 3,946,936 | 3/1976 | Brown | 206/806 |
| 3,985,232 | 10/1976 | Johnson | 206/461 |
| 4,106,615 | 8/1978 | Hiroshi | 206/45 |
| 4,201,292 | 5/1980 | Davidson et al. | 206/621 |
| 4,266,671 | 5/1981 | Roccaforte | 206/626 |
| 4,291,807 | 9/1981 | Giordano et al. | 206/626 |
| 4,331,240 | 5/1982 | Vanasse | 206/621 |
| 4,344,533 | 8/1982 | Olsen | 206/621 |
| 4,360,106 | 11/1982 | Irvine et al. | 206/626 |

*Primary Examiner*—Gary E. Elkins

*Attorney, Agent, or Firm*—Rhodes, Coats & Bennett

[57] ABSTRACT

A folding carton having a fifth wall which serves as a space for advertising and to hang the carton for display. The fifth wall is constructed as to be easily torn away by the purchaser to obtain initial access to the carton. After removal of the fifth panel, a tuck remains hingedly secured to the cover for reclosure. The rear panel and closure tuck of the carton remain intack and substantially undisturbed by the removal of the fifth wall.

5 Claims, 5 Drawing Sheets

FOLDING CARTON WITH RECLOSABLE TUCK AND DISPOSABLE HANG PANEL

BACKGROUND AND SUMMARY OF THE PRESENT INVENTION

The present invention relates generally to folding cartons and, more particularly, to a folding carton having a fifth panel or wall which may be utilized for advertising and display of merchandise yet, upon purchase, can be easily removed leaving behind a reclosable carton.

Packages for such items as condoms, magnetic tape, computer disks, and the like have been developed in recent years. Such cartons are initially filled from one end and sealed. The cartons then include a fifth panel which extends upwardly from the rear wall of the carton. The fifth wall serves as a surface for advertising, as well as serving to hang a plurality of cartons on a display rack. In such condition, any attempts to gain access to the contents is later easily noted. Once the purchaser selects and removes one of the cartons, the fifth wall is torn away and removed to gain access to the contents of the package. In some cartons which have been developed more recently, once the fifth wall is removed, it is desired to reclose the carton when less than all of the contents are initially used.

There is illustrated and described in U.S. Pat. No. 4,106,615 a foldable carton having a fifth wall which serves as a surface for advertising and includes a means for hanging the carton from a display rack. However, no means is described in this patent for providing for the reclosure of the top flap of the box once the fifth wall is removed.

Most examples of prior art cartons provide for the disposal of the carton when the contents are initially removed. In such cartons, no attempt is made to retain the tubular portion as a reusable carton after the fifth wall is removed. Examples of this concept are illustrated in the Johnson, U.S. Pat. No. 3,985,232 and Nowak et al. U.S. Pat. No. 3,237,836.

One known example of a folding carton which has a removable fifth wall, and in which the remaining carton is intended to be used as a reusable box is described and illustrated in Giordano et al. U.S. Pat. No. 4,291,807. While the carton blank is provided with tear-lines for tearing the fifth wall away by the customer after purchase, a significant portion of the rear wall is also torn away, and the exposed outer surface of the closure tuck is torn away. The result is that the carton loses a substantial portion of its rigidity and sturdiness, and the outer visible surface of the closure tuck is unsightly.

In the present invention, the above described problems are addressed and overcome. In general, provisions are made for tearing away the fifth wall without disturbing the rear panel and with very little damage to the closure tuck or flap. Further, the carton blank of the present invention includes a lift-tab which facilitates the opening of the carton and makes removal of the fifth wall easier. As a result, the present invention provides a more positive reclosure feature, does not destroy the tuck or rear wall for reclosure, provides for easier opening, and further provides a compartment between the walls forming the fifth panel in which advertising coupons may be emplaced.

More particularly, the fifth wall of the carton of the present invention is formed by a plurality of rectangular panels or sections. A hinged double fold fifth wall having a front and rear panel extends upwardly from the upper edge of the rear wall of the carton along a first tear-line. The panel which forms the top wall of the carton includes a hinged closure flap extending upwardly from the rear edge thereof. The carton is then so folded that the closure flap of the top wall is folded up and attached between the lower portion of the front panel and the rear panel. The lower portion of the front panel is releasably secured to the adjacent outer surface of the hinged closure flap by spot gluing portions thereof, and the rear panel is relatively permanently secured to the hinged closure flap by a full glue strip.

Thus, when the front panel of the fifth wall is pulled and released, the front panel is freed from the hinged closure flap, and the front and upper portion of the rear panels and pull-tab are torn away as a unit from the remaining portion of the rear panel. The remaining portion of the rear panel and the closure flap are then severed from the top of the rear wall and folded downwardly to reclose the carton.

It is, therefore, an object of the present invention to provide an improved folding carton of the type having a reclosable tuck or flap and a disposable hangpanel.

It is another object of the present invention to provide a folding carton of the type in which the hangpanel may be more easily removed.

It is still another object of the present invention to provide a folding carton of the type described which has more positive reclosure capabilities.

It is yet another object of the present invention to provide a folding carton of the type described that, when the hang-panel is removed, the reclosable carton remaining retains more of its structural integrity.

Another object of the present invention is to provide a folding carton of the type described which allows removal of the hang-panel without destruction of any portion of the rear wall.

Finally, another object of the present invention is to provide a blank which, when folded and assembled, achieves the objects set forth hereinabove.

Other objects and a fuller understanding of the invention will become apparent from reading the following detailed description of a preferred embodiment along with the accompanying drawings in which:

FIG. 1 s a front perspective view of the folding carton of the present invention.

DETAILED DESCRIPTION OF A PREFERRED EMBODIMENT

Figure 1:
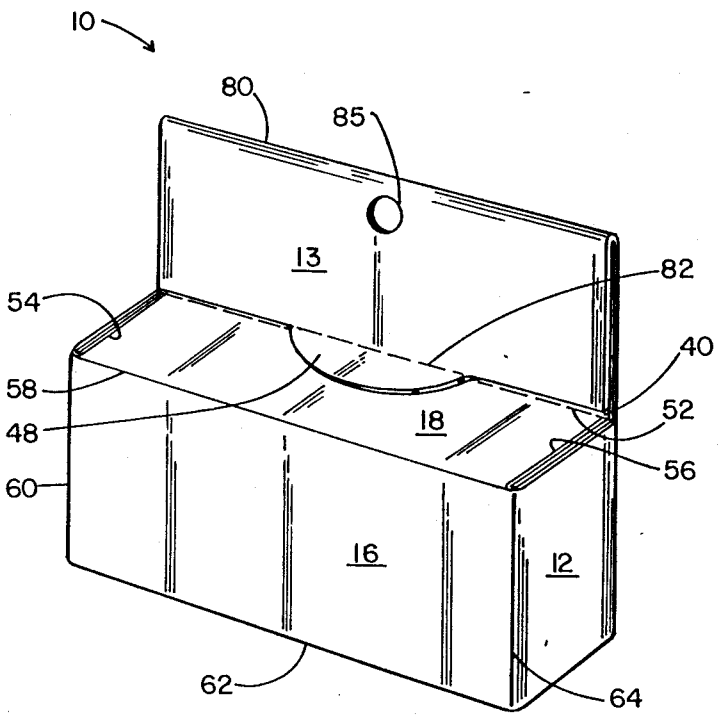
Figure 5:
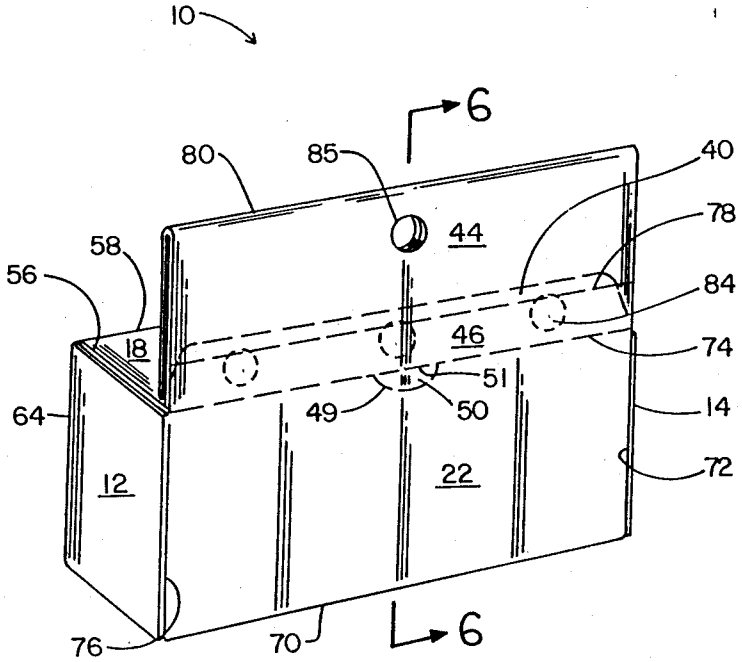
FIG. 5 is a rear perspective view of the carton of FIG. 1.

Turning now to the drawings, the assembled carton is best shown in FIGS. 1 and 5. In the assembled condition, prior to the time the customer purchases the carton and removes the rear panel, the carton appears as illustrated in FIGS. 1 and 5. The carton 10 includes a front wall 16, a rear wall 22, a bottom wall 20 and a top wall 18. A pair of end walls 12,14 complete the carton. A fifth wall 13 extends upwardly from rear wall 22 and includes an opening 85 therein for hanging the carton from a display rack. The fifth wall may include thereon additional advertising, redeemable coupons, and the like. It is also possible to discreetly emplace redeemable coupons between the front and rear panels forming the fifth wall 13.

As described hereinabove, carton 10 is so constructed as to facilitate removal of the fifth wall 13 without removal of any portion of the rear wall 22 and with only minor cosmetic damage to the closure flap. The remainder of this specification will describe the manner in which these objectives are met.

The heart of the invention, as far as meeting the above objectives is concerned, lies in the manner in which the fifth wall 13 is formed and the relationship between the closure tuck and the panels forming the fifth wall. For example, as illustrated in FIG. 5, the tear-line 74 between rear wall 22 and the fifth wall 13 is coincidental with the top edge of rear wall 22. Thus, when the rear wall 13 is torn away, the rear wall 22 is substantially undisturbed. This is not the case with the rear wall 23 of the Giordano et al U.S. Pat. No. 4,291,807 (referenced hereinabove).

Figure 4:
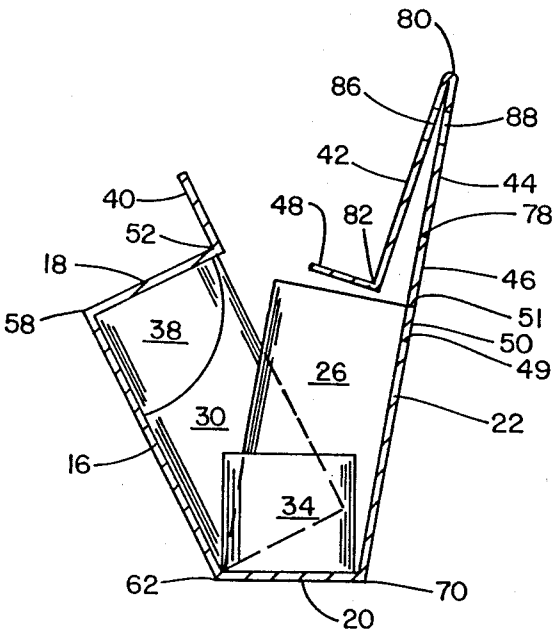
FIG. 4 is a cross-sectional view of the carton of FIG. 3 prior to the completion thereof.
Figure 6:
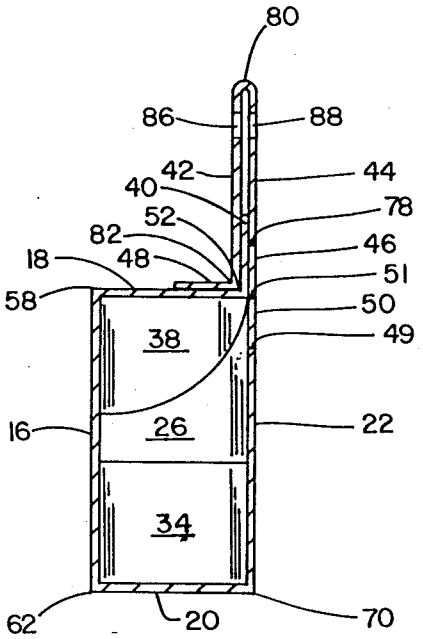
FIG. 6 is a sectional view taken substantially along lines 6—6 in FIG. 5.

Also, referring to FIGS. 4 and 6, the reclosable tuck 40 is initially folded upwardly and emplaced between the front panel 42 and the rear panel 44,46 of fifth wall 13. So positioned, when the fifth wall 13 is removed from the rear wall 22, the face of the closure tuck 40 is relatively undisturbed.

Figure 2:
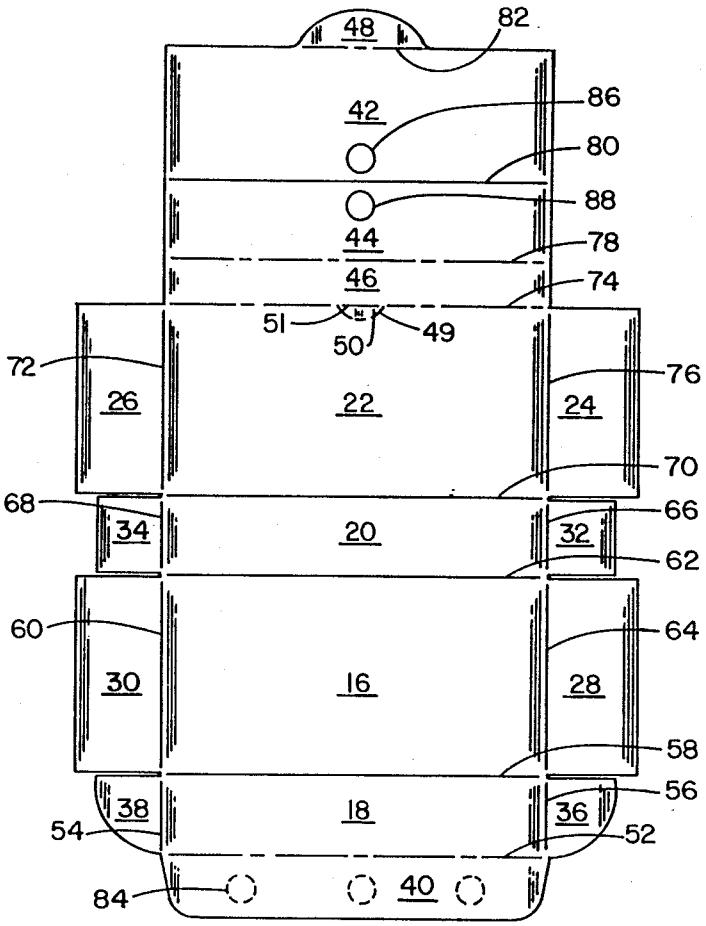
FIG. 2 is a plan view of the carton blank from which the carton of FIG. 1 is formed.

For purposes of illustration, the blank that is initially cut using scored lines for folds and serrated lines for eventual tearing of one section from another is shown in FIG. 2. Primarily, the carton 10 is formed of a plurality of substantially rectangular panels arranged in a column one above the other as illustrated in FIG. 2. Front panel 16 and rear panel 22 are separated along fold lines 62,70 by a panel 20 which forms the bottom wall. Panel 18 forms the top wall and is connected to front wall 16 by fold-line 58. Tuck panel 40 is connected to the rear edge of top wall 18 by a fold-line 52. The fifth wall 13 is formed of a front panel 42 and a rear panel which, in turn, is formed of an upper panel section 44 and a lower panel section 46. Panel section 46 eventually becomes a glue panel and is connected to the upper edge of rear panel 22 by a score or tear-line 74. A tab 50 is secured to the central lower edge of glue panel 46 by a fold-line 51, and is scored along arcuate line 49 to facilitate removal from the rear panel 20 along with glue panel 46 as will be explained hereinafter. The upper portion 44 is connected to the lower portion 46 by another tearline 78. As used hereinafter, the tear-line 78 will be referred to as the first tear-line, and the tear-line 74 will be referred to as the second tear-line. The panel 42 becomes the front panel of the fifth wall 13 and is attached to the upper edge of the upper portion 44 by fold line 80. A pull tab 48 is attached to the upper edge of the front panel 42 of fifth wall 13 by a fold-line 82.

End flaps 24,26 are attached to the rear panel or wall 22 by fold-lines 76,72 respectively; end flaps 28,30 are attached to front wall or panel 16 by foldlines 64,60 respectively; end flaps 32,34 are attached to the bottom wall 20 by fold-lines 66,68 respectively; and end flaps 36,38 are attached to the top wall 18 by fold-lines 56,54 respectively.

A pair of openings 86 in the front panel 42 of the fifth wall 13 and 88 in the upper portion 44 of the rear panel of the fifth wall 13 are provided so that, when the fifth wall panels are folded, openings 86,88 become aligned to provide an opening 85 for hanging the carton 10 by the fifth wall 13. Glue spots or areas 84 are provided on the underneath side of closure tuck or flap 40 for reasons to be described hereinafter.

Figure 3:
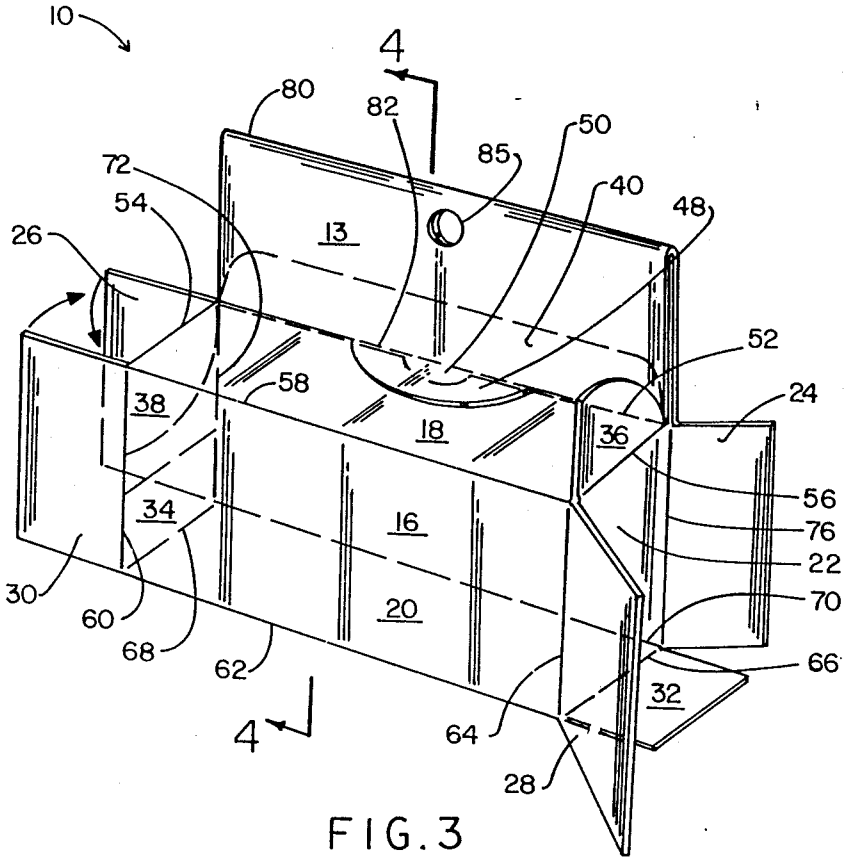
FIG. 3 is a perspective view illustrating the blank of FIG. 2 in its partially folded configuration ready for the insertion of products thereinto.

After the carton blank has been printed on the outside surface and cut as illustrated in FIG. 2, the next step is to apply a finishing shellac to the printed surface, then to apply glue or adhesive to the proper areas, fold the box into the form illustrated in FIG. 3. Glue is applied to the entire lower portion 46 of the rear panel of the fifth wall 13. Glue is also applied to the spots 84 on the undersurface of the closure flap 40 as illustrated in FIG. 2. The first fold is then made along fold-line 62 between the lower edge of the front wall and the front edge of the bottom wall. The second fold is along fold-line 80 between the front panel 42 and the upper portion 44 of the rear panel of fifth wall 13. Pressure is then brought to bear on the fifth wall 13, so that the closure flap or tuck 40 becomes permanently adhered to the lower portion 46 of the rear panel of fifth wall 13, and the spot glued portions of the eventually exposed face of tuck 40 becomes temporarily secured to the underneath side of the front panel 42 of fifth wall 13. This is the condition in which the carton is preferably shipped from the carton manufacturer to the packagers of the items to be emplaced therein. As can be seen, the cartons are shipped flat, then erected and filled.

When the cartons are ready to be filled and after the adhesive or glue has dried, the carton 10 is formed into the shape shown in FIG. 3 by folding the rear edge of bottom wall 20 and the lower edge of rear wall 22 up along fold-line 70, and by folding the front edge of top wall 18 and the upper edge of front wall 16 along fold-line 58. Upon completion of these steps, the configuration of FIG. 3 has been obtained.

The end flaps at one end of the carton are then closed and the adjacent surfaces of panels 26 and 30 are glued together. The articles to be emplaced within the carton are then inserted from the opposite end, and then the end flaps at the opposite end are closed and glued together in the same manner. The loaded carton is then completed and exists in the configuration illustrated in FIGS. 1 and 5.

After a customer purchases the loaded carton 10, and wishes access to the contents therein, the customer first lifts up on pull-tab 48 releasing the front panel 42 from the glue spots 84 on the closure tuck. The fifth wall can then be easily removed by tearing panels 42 and 44 from panel 46 along tear-line 78. The fifth wall can then be discarded.

Figure 8:
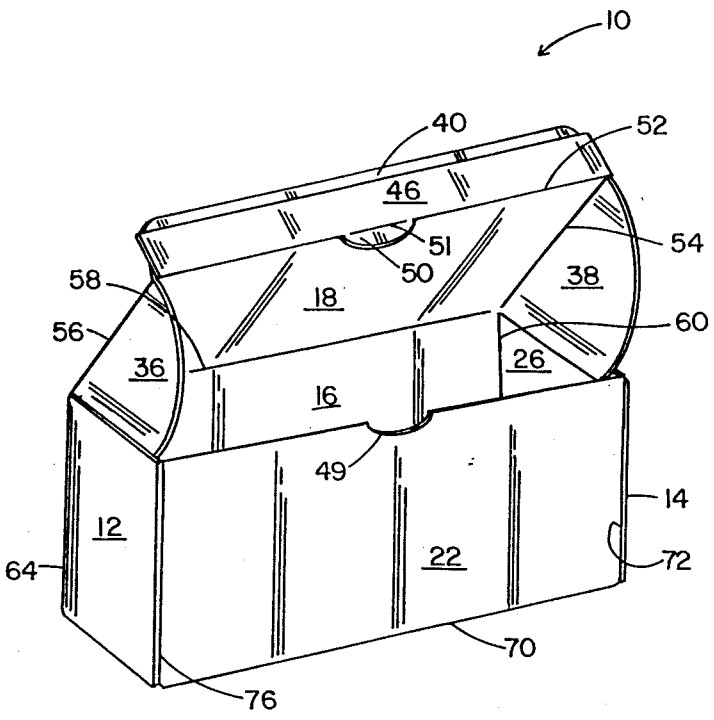
FIG. 8 is a rear perspective view similar to FIG. 7, except showing the carton after the closure flap is severed from the rear edge of the top wall.
Figure 7:
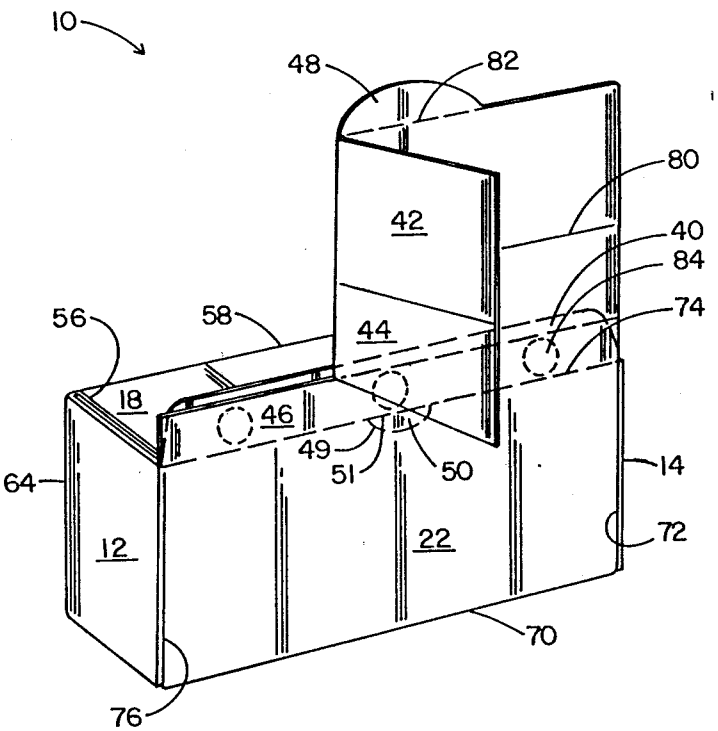
FIG. 7 is a rear perspective view illustrating the manner in which the fifth panel is torn away from the remainder of the carton.

Referring now to FIG. 8, the carton is still sealed with the closure flap 40 and panel 46 adhered thereto extending rearwardly upwardly from the upper edge of rear wall 22. A second tear is then made along tear-line 74 which releases the glue panel 46 and closure tuck 40 as an integral unit from the upper edge of rear wall 22. The closure tuck 40 is then bent in the reverse direction.

Figure 9:
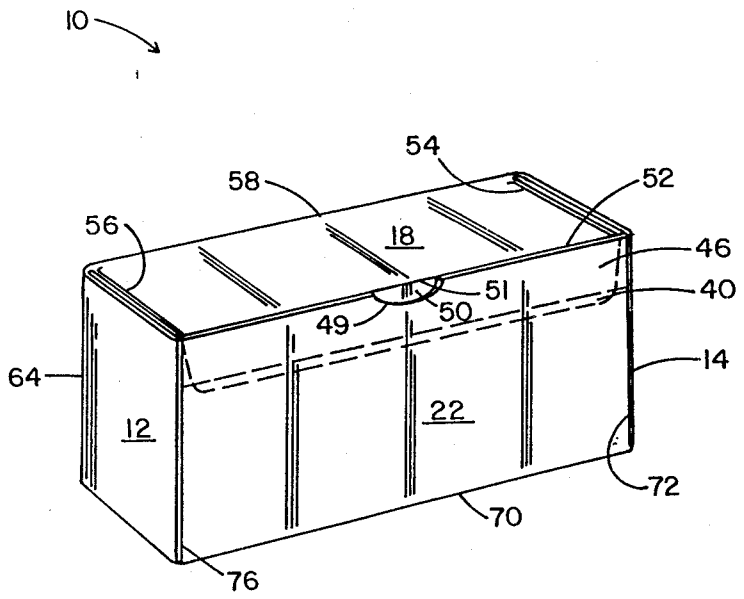
FIG. 9 is a rear perspective view of the folding carton with the fifth panel torn off and the tuck panel emplaced.

The top of the carton is now open as illustrated in FIG. 8, and one or more items can be removed therefrom. The tuck is then reinserted immediately in front of the rear wall, and the carton is reclosed as illustrated in FIG. 9. Note that the rear wall 22 is substantially undisturbed. No significant portion of the rear wall has been torn away. As a result, the carton is more rigid and better protects the contents thereof.

While a preferred embodiment has been described in detail hereinabove, it is apparent that various changes and modifications might be made without departing from the scope of the invention which is set forth in the accompanying claims.

What is claimed is:

1. A folding carton having a front wall, a bottom wall, a rear wall, and a cover hingedly secured to said front wall comprising:

(a) said cover having a closure flap hingedly attached to the rear edge thereof, said closure flap having an inner and outer surface;

(b) a fifth wall extending upwardly from the top edge of said rear wall and comprising a plurality of rectangular panels including:

(i) a first, relatively narrow panel attached to the upper edge of said rear wall along a second tear-line;

(ii) a second panel of intermediate width attached to the upper edge of said first panel along a first tear-line;

(iii) a third panel of a width substantially equaling the combined widths of the first and second panels and connected to the upper edge of said second panel by a fold-line;

(iv) a pull-tab attached to the upper edge of said third panel by a fold-line;

(c) said inner surface of said closure flap being relatively permanently secured to said first panel substantially across the length and width thereof, said closure flap being positioned behind the lower portion of said third panel which has been folded down along said fold-line;

(d) the lower portion of said third panel being relatively releasably secured to the adjacent outer surface of said closure flap by spot glue areas;

(e) said pull-tab being folded forwardly and lying loosely along said top wall;

(f) whereby to open said carton, (i) said pull-tab is pulled upwardly freeing said third panel from said closure flap;

(ii) said second and third panel and glue-tab are torn away as a unit from said first panel, and (iii) said first panel which is secured to the inner surface of said closure tuck is severed from the top edge of the rear wall along said second tear-line and folded downwardly to form said closure tuck.

2. A folding carton having a front wall, a bottom wall, a rear wall, and a cover hingedly secured to said front wall, said carton comprising:

(a) said cover having a closure flap hingedly attached to the rear edge thereof, said closure flap having an inner and outer surface;

(b) a fifth wall extending upwardly from the top edge of said rear wall and comprising a rear panel attached to the upper edge of said rear wall along a tear-line and a front panel connected to the upper edge of said rear panel by a fold-line;

(c) said inner surface of said closure flap being relatively permanently secured to a portion of said rear panel, said closure flap being positioned behind the lower portion of said front panel which has been folded down along said fold-line;

(d) the lower portion of said front panel being relatively releasably secured to the adjacent outer surface of said closure flap by spot glue areas;

(e) means for tearing said front panel and the upper portion of said rear panel from the lower portion of said rear panel;

(f) whereby to open said carton, (i) said front panel is pulled upwardly and freed from said closure flap, (ii) said front panel and the upper portion of said rear panel are torn away as a unit from the lower portion of said rear panel, and (iii) said lower portion of said rear panel which is secured to the inner surface of said closure tuck is severed from the top edge of the rear wall along said tear-line and folded downwardly to form said closure tuck.

3. The folding carton according to claim 2 wherein said means for separating said front panel and the upper portion of said rear panel from the lower portion of said rear panel comprises a tear-line.

4. A carton blank for folding into a carton having a front wall, a bottom wall, a rear wall, and a cover hingedly secured to said front wall, said blank comprising:

(a) a plurality of rectangular panels, all of which have substantially the same length but varying widths;

(b) one of the larger of said rectangular panels forming a front wall having an upper and lower edge, a top wall or cover having its front edge secured to the top edge of said front wall by a fold-line and having its rear edge secured to a closure tuck or flap by another fold-line;

(c) a bottom wall comprising a relatively narrow panel having front and rear edges, the front edge thereof being secured to the lower edge of said front wall;

(d) a rear wall or panel being approximately the same size and shape as said front wall and having an upper and lower edge, the lower edge of said rear wall being hingedly secured to the rear edge of bottom wall;

(e) a fifth wall formed of three adjacent panels extending upwardly from the upper edge of said rear wall;

(i) the lowermost of said three panels being relatively narrow and being releasably attached to the upper edge of said rear wall;

(ii) the intermediate panel of said fifth wall being releasably attached to the upper edge of said lowermost panel;

(iii) the uppermost of said panels of said rear wall being of a width substantially equaling the combined width of said first and second panels and hingedly connected to the upper edge of said intermediate panel;

(f) said lowermost panel of said fifth wall being provided with an adhesive coating on the inner surface thereof and said closure flap being provided with a plurality of intermittent areas containing adhesive on the outer surface thereof, whereby, when folded, the inner surface of said closure flap is secured to the lowermost of said panels and the uppermost of said panels of said rear wall is folded down into releasable contact with said intermittently spaced adhesive sections;

(g) the end edges of the panels forming said front wall, rear wall, bottom wall, and top wall being provided with end flaps hingedly secured thereto; and (h) said carton being provided with scored lines extending between adjacent panels that are to be folded and with serrated lines between panels that are to be separated.

5. The blank according to claim 4 and further including a pull tab hingedly connected to the upper edge of the uppermost panel of said fifth wall.

* * * * *